US012419362B2

(12) United States Patent
Wu

(10) Patent No.: US 12,419,362 B2
(45) Date of Patent: Sep. 23, 2025

(54) LIGHT BIB BODY AND BIB

(71) Applicant: WUYUAN YUCHEN BABY PRODUCTS CO., LTD, Jiangxi (CN)

(72) Inventor: Huafei Wu, Jiangxi (CN)

(73) Assignee: WUYUAN YUCHEN BABY PRODUCTS CO., LTD, Jiangxi (CN)

( * ) Notice: Subject to any disclaimer, the term of this patent is extended or adjusted under 35 U.S.C. 154(b) by 121 days.

(21) Appl. No.: 17/921,982

(22) PCT Filed: Apr. 22, 2021

(86) PCT No.: PCT/CN2021/089074
§ 371 (c)(1),
(2) Date: Oct. 28, 2022

(87) PCT Pub. No.: WO2022/012108
PCT Pub. Date: Jan. 20, 2022

(65) Prior Publication Data

US 2023/0172285 A1 Jun. 8, 2023

(30) Foreign Application Priority Data

Jul. 17, 2020 (CN) ..... 202021422644.7

(51) Int. Cl.
*A41B 13/10* (2006.01)

(52) U.S. Cl.
CPC ..... *A41B 13/103* (2013.01)

(58) Field of Classification Search
CPC ..... A41B 13/10; A41B 13/103
See application file for complete search history.

(56) References Cited

U.S. PATENT DOCUMENTS 4,663,779 A * 5/1987 Bible ..... A41B 13/103 2/49.3
7,143,448 B1 * 12/2006 Gottehrer ..... A41B 13/103 2/52

(Continued)

FOREIGN PATENT DOCUMENTS

CN 201571505 9/2010
CN 204907966 12/2015

(Continued)

OTHER PUBLICATIONS

"International Search Report (Form PCT/ISA/210) of PCT/CN2021/089074," mailed on Jul. 29, 2021, with English translation thereof, pp. 1-5.

(Continued)

*Primary Examiner* — Sally Haden
(74) *Attorney, Agent, or Firm* — Jiwen Chen; Joywin IP Law PLLC

(57) ABSTRACT

A light bib body and a bib are provided. The light bib body comprises a front bib piece (3) and a rear bib piece (4), creating a cavity between them for containing food residues. The whole upper edge of the front bib piece (3) is higher than the upper edge of the rear bib piece (4). A bib cloth (1) supported by the light cloth, overlays the bib body, with a first covered edge (5) enveloping their outlines. The lower upper edge of the rear bib piece reduces bib body weight, enhancing comfort while concealing wiring with a second covered edge (7) for improved aesthetics. Sewing strips (10) connect the bib body and the bib cloth (1), maintaining the bib's opening degree for effective residue collection. Convex strips (13) on inner surfaces ensure the bib stays open, enhancing stability.

6 Claims, 7 Drawing Sheets

(56) References Cited

U.S. PATENT DOCUMENTS

| | | | | |
|---|---|---|---|---|
| 7,269,857 | B2 | 9/2007 | Cymbol | |
| 9,392,821 | B1 * | 7/2016 | Baker | A41B 13/103 |
| 10,231,490 | B2 * | 3/2019 | Bisson | A41B 13/103 |
| 2011/0067161 | A1 * | 3/2011 | Perazzo | A41B 13/103 2/49.3 |
| 2013/0291276 | A1 * | 11/2013 | Monahon | A41B 13/103 2/49.1 |

FOREIGN PATENT DOCUMENTS

| | | |
|---|---|---|
| CN | 205125106 | 4/2016 |
| CN | 109965373 | 7/2019 |
| CN | 210076590 | 2/2020 |
| CN | 212728813 | 3/2021 |

OTHER PUBLICATIONS

"Written Opinion of the International Searching Authority (Form PCT/ISA/237) of PCT/CN2021/089074," mailed on Jul. 29, 2021, pp. 1-4.

* cited by examiner

LIGHT BIB BODY AND BIB

CROSS-REFERENCE TO RELATED APPLICATION

This application is a 371 of international application of PCT application serial no. PCT/CN2021/089074, filed on Apr. 22, 2021, which claims the priority benefit of China application no. 202021422644.7, filed on Jul. 17, 2020. The entirety of each of the above mentioned patent applications is hereby incorporated by reference herein and made a part of this specification.

TECHNICAL FIELD

The disclosure relates to the field of baby products, and in particular, to a light bib body and a bib.

RELATED ART

Infants and toddlers often get their clothes dirty accidentally even if someone is around them and taking care of them all the time, so they are often put on bibs around their neck on the chests to prevent all kinds of stains from sticking to their clothes. Dirty bibs need cleaning, and silicone bibs are easier to clean than cloth bibs because the bottom of the pockets of cloth bibs has large gaps in the stitching, which are difficult to clean. However, the silicone material is heavier than the cloth material and the silicone material is less tactile. If a toddler wears a heavy and non-skin-friendly bib around his/her neck for a long time, it will inevitably cause discomfort to the toddler.

The Chinese invention patent of CN200920299678.9 discloses a bib comprising a bib piece used for being tied in the front of a breast. The bib piece is movably connected with a bib support through a press button, and the bib piece is provided with a neck strap formed by lapping two pieces through sticking buttons. When a child has a dinner, the bib piece is tied in the front of the breast of the child through the neck strap, and the bib support is used for collecting food spilled by the child and preventing the food from being spilled onto clothes or ground. The bib is detachable, but in order to implement the detachment, the rear of the bib support is raised for being connected the bib piece, which inevitably increases the weight of the bib support and reduces the comfort in use.

SUMMARY OF DISCLOUSRE

Technical Problem

Solution to Problem

Technical Solution

To solve the above technical problems, the disclosure provides a light bib body including a front bib piece and a rear bib piece that are integrally formed, where an accommodating cavity for containing food residues is formed between the front bib piece and the rear bib piece, and a whole upper edge of the front bib piece is higher than an upper edge of the rear bib piece, and the design of the bib body with a high front and a low back ensures that food residues can fall into the accommodating cavity of the bib body and the weight of the bib body is reduced, so the bib body is suitable for a toddler to use.

The disclosure further provides a bib including the light bib body and a piece of bib cloth made of light cloth, the bib body is sewn below the bib cloth, and outer outlines of the two are wrapped by a first covered edge.

Technical solutions provided by the disclosure are implemented through the following manners.

A light bib body includes a front bib piece and a rear bib piece that are integrally formed. An accommodating cavity for containing food residues is formed between the front bib piece and the rear bib piece, and a whole upper edge of the front bib piece is higher than an upper edge of the rear bib piece.

It should be explained that generally speaking, the front bib piece being higher than the rear bib piece, which in a narrow sense means that, except for the end portions of the two, the front bib piece upper edge is always higher than the rear bib piece upper edge at the same position. In a broad sense, it means that not every part in the strict sense is high, and the overall design is for the purpose of reducing the weight of the bib body. The design of the bib body with a high front and a low back ensures that food residues can fall into the accommodating cavity of the bib body and the weight of the bib body is reduced, so the bib body is suitable for a toddler to use and allows the toddler to use it comfortably.

Preferably, the whole upper edge of the rear bib piece upper edge is concave and forms a concave arc, or the whole upper edge of the rear bib piece is horizontal.

Preferably, the rear bib piece is generally flat, the front bib piece is a three-dimensional curved surface and forms an upward-facing opening together with the rear bib piece, and the opening is at an upper end of the accommodating cavity. The bib body is required to be provided with an opening to allow food residues to fall into the accommodating cavity, and the direction of the opening is required to face upwards to collect food residues dropped by a toddler.

Preferably, the front bib piece upper edge is an arc that is low at both ends and high in the middle. Although this increases the weight of part of the front bib piece, it is advantageous in terms of the original function of the bib body: because the front bib piece is a three-dimensional curved surface, the front bib piece with a high middle height extends outwards in a large range, so that food residues can easily enter the accommodating cavity. Further, after the bib body is combined with the bib cloth, the front bib piece upper edge may block the connection between the bib cloth and the rear bib piece upper edge, and attractiveness is thus improved.

Preferably, upper edges of two end portions of the rear bib piece are higher than upper edges of end portions of the front bib piece.

Preferably, an outer outline of the rear bib piece has a narrow and flat sewing strip extending outwards. Left and right ends of the rear bib piece are provided with extension portions extending outwards and overlapping with the sewing strip. The extension portions are higher than the upper edges of the end portions of the front bib piece. The arrangement of the sewing strip makes the bib body and the bib cloth integrally connected without affecting the opening degree of the bib body, so that food residues may fall into the bib body. The arrangement of the extension portions allows the bib body to be wrapped by a longer length when the bib body is connected to the bib cloth, so that the connection between the two is stable.

Preferably, the front bib piece and the rear bib piece are made of a soft rubber material, and an inner surface of the front bib piece and an inner surface of the rear bib piece are provided with convex strips that that arranged in an alternating manner. The soft rubber material is skin-friendly and more suitable for toddlers. The convex strips can keep the curved shape of the front bib piece and the rear bib piece, and the opening shape of the bib body is thereby kept.

A bib includes the light bib body and a piece of bib cloth made of light cloth, and the bib body is sewn below the bib cloth. Both sides of the bib cloth are provided with a first covered edge, the first covered edge extends downwards from the junction of the bib cloth and the rear bib piece and is wrapped on the sewing strip of the bib body. The bib cloth is further provided with a second covered edge, and the second covered edge is sewn on the rear bib piece upper edge.

Preferably, the second covered edge formed by folding below the bib cloth is wrapped and sewn on the rear bib piece upper edge. A gap between the lower end of the bib cloth and the rear bib piece upper edge, which allows dirt to fall out, is prevented from being formed.

Preferably, the sewing strip, the extension portions, and the outer outline of the bib cloth are all wrapped by a first covered edge, and the first covered edge surrounds the bib body and the bib cloth. The integrated connection between the bib cloth and the bib body is achieved, so that the attractiveness of the bib as a whole is more attractive, and stable connection is provided.

Beneficial Effects of Disclosure

Beneficial Effects

1. Regarding the light bib body provided by the disclosure, the whole upper edge of the rear bib piece is lower than the upper edge of the front bib piece, so that the weight of the bib body is reduced, improved comfort is provided, materials are saved, and costs are lowered.
2. The convex strips on the inner surface of the front bib piece and the inner surface of the rear bib piece keep the bib body open, so that most of the dropped food residues are dropped into the accommodating cavity of the bib body.
3. Regarding the bib, the whole upper edge of the front bib piece of the bib body is higher than the upper edge of the rear bib piece, and the second covered edge is wrapped on the rear bib piece upper edge. In this way, the front bib piece may block the connection between the bib cloth and the rear bib piece upper edge and hide the wiring of the second covered edge, and overall attractiveness of the bib is thus improved.
4. The arrangement of the sewing strip and the first and second covered edges makes the bib body and the bib cloth integrally connected without affecting the opening degree of the bib body. In this way, food residues may fall into the bib body, the bib as a whole exhibits improved attractiveness, and stable connection is provided.

BRIEF DESCRIPTION OF THE DRAWINGS

Description of the Drawings

Figure 1:
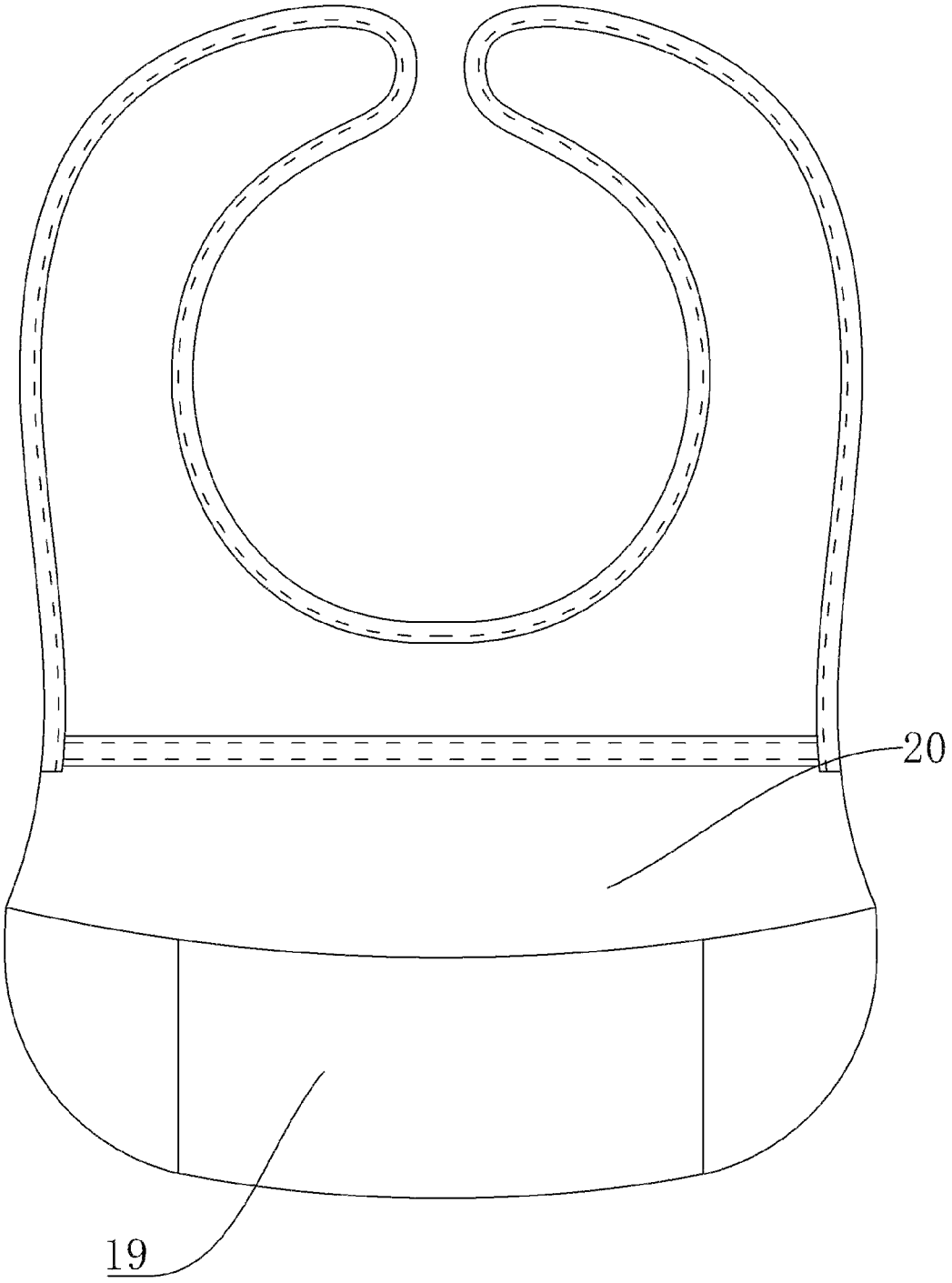

FIG. 1 is a front view of a soft rubber bib body which can be easily found on the market in the related art.

Figure 2:
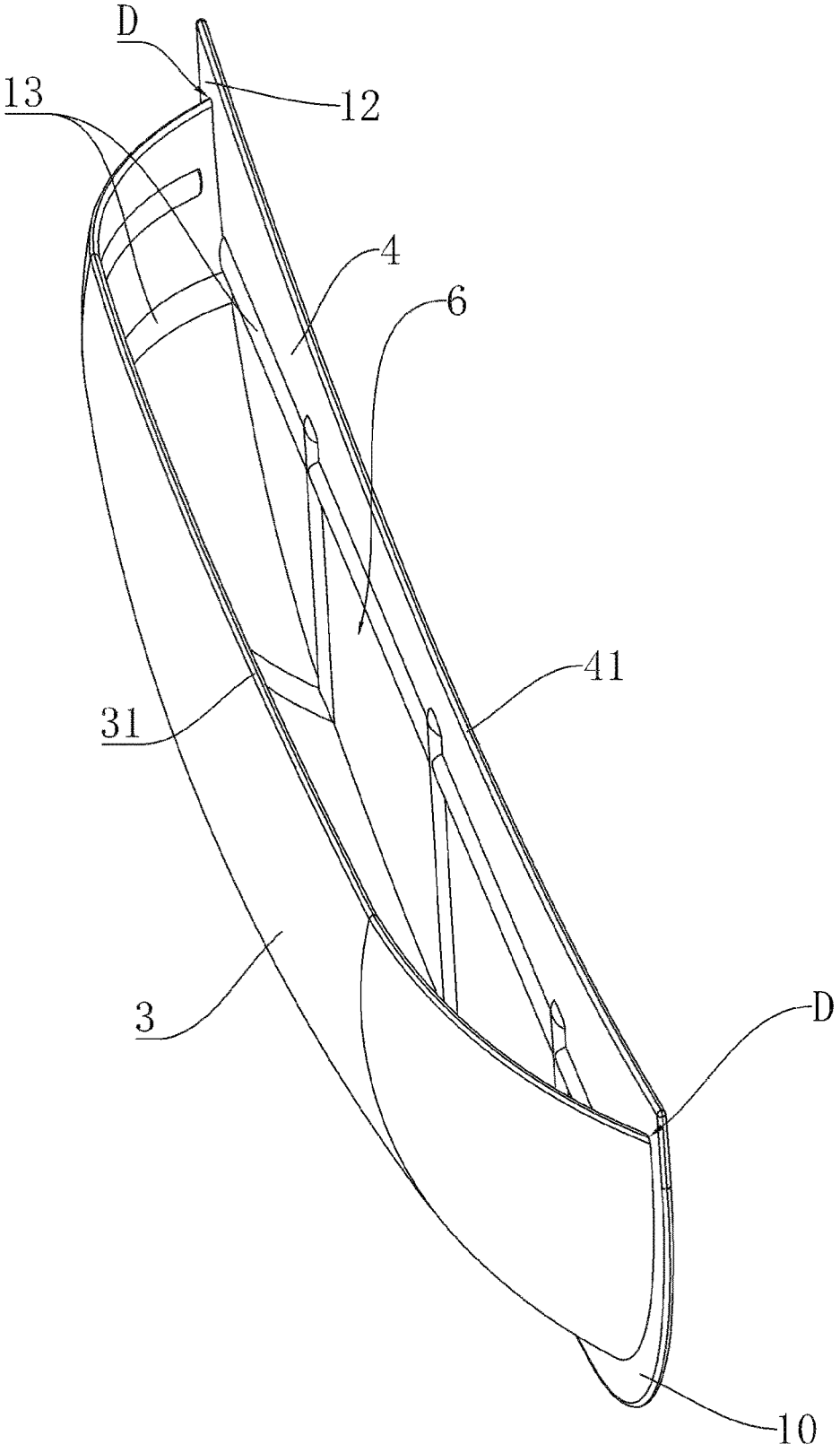

FIG. 2 is a schematic view 1 of a three-dimensional structure of a bib body according to an embodiment of the disclosure.

Figure 3:
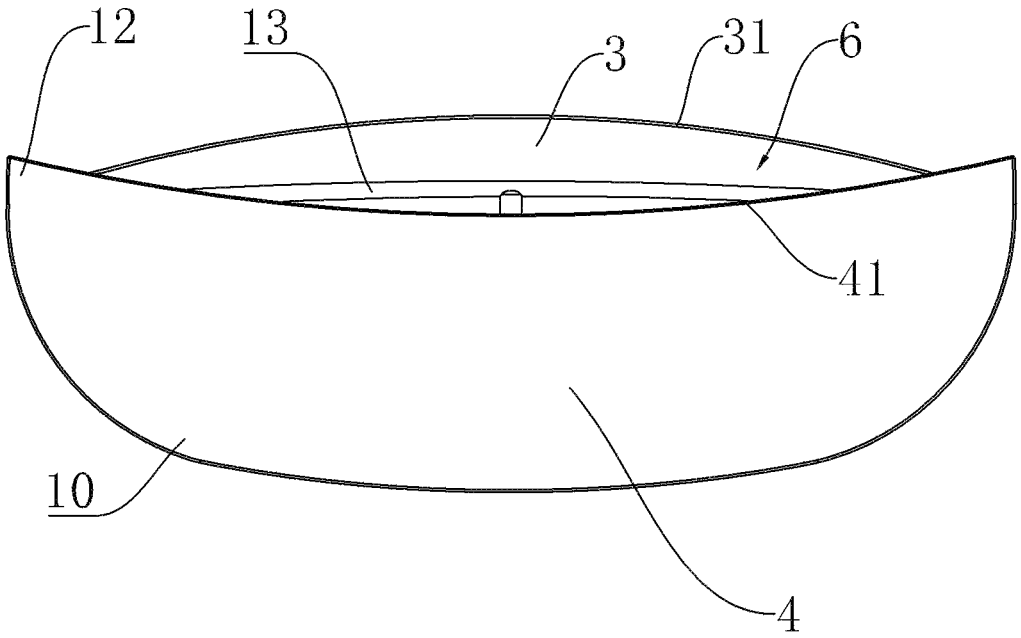

FIG. 3 is a rear view of the bib body according to an embodiment of the disclosure.

Figure 4:
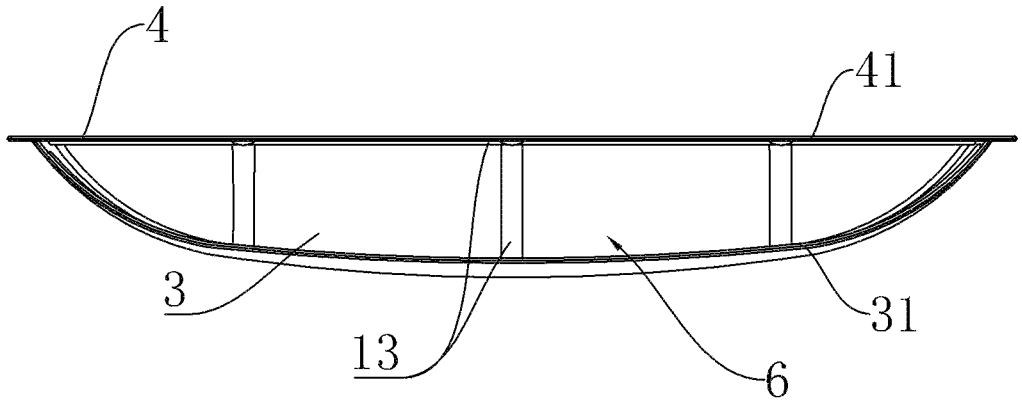

FIG. 4 is a top view of the bib body according to an embodiment of the disclosure.

Figure 5:
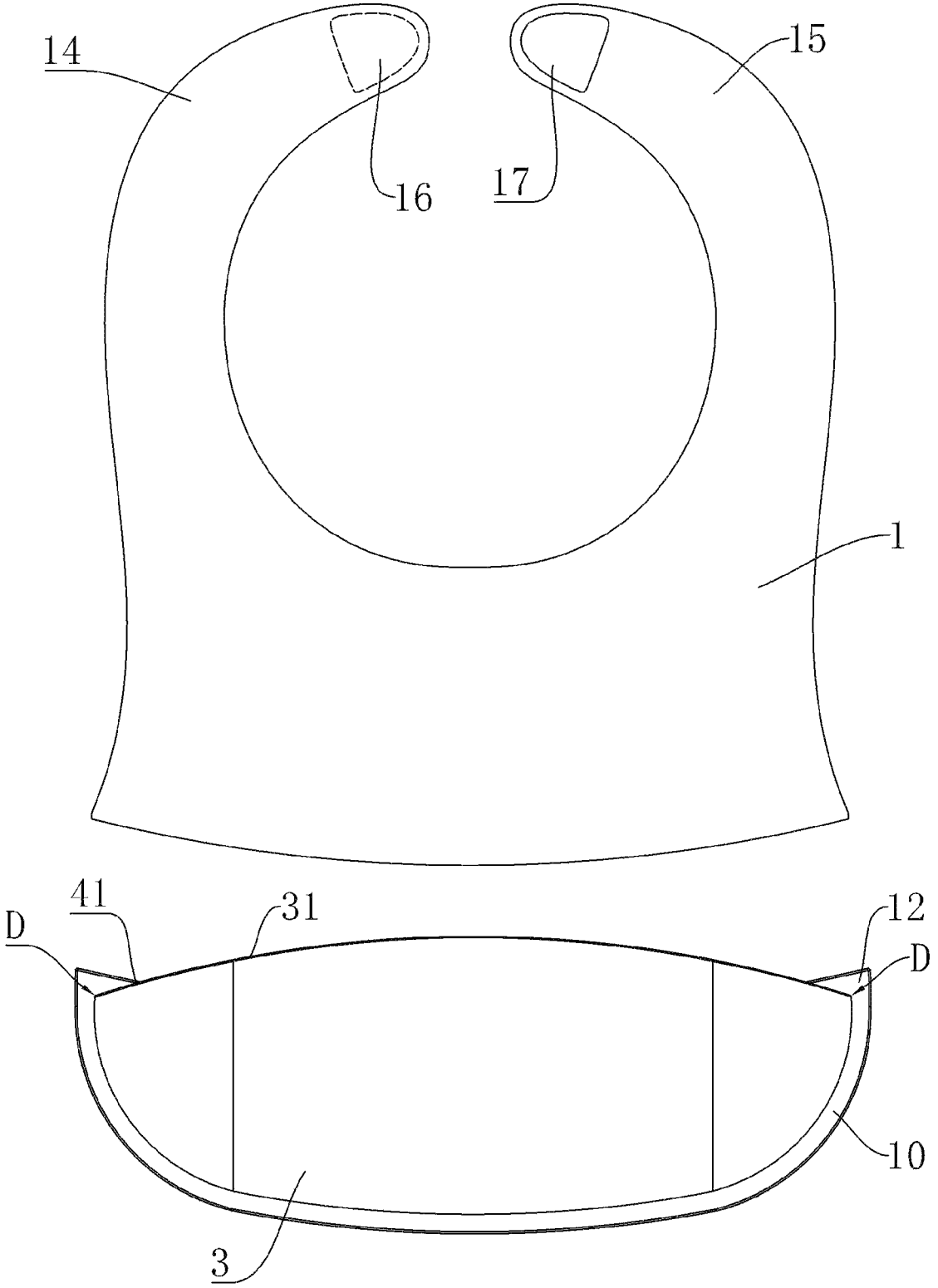

FIG. 5 is a top view of the bib body and a piece of bib cloth when the two are not combined according to an embodiment of the disclosure.

Figure 6:
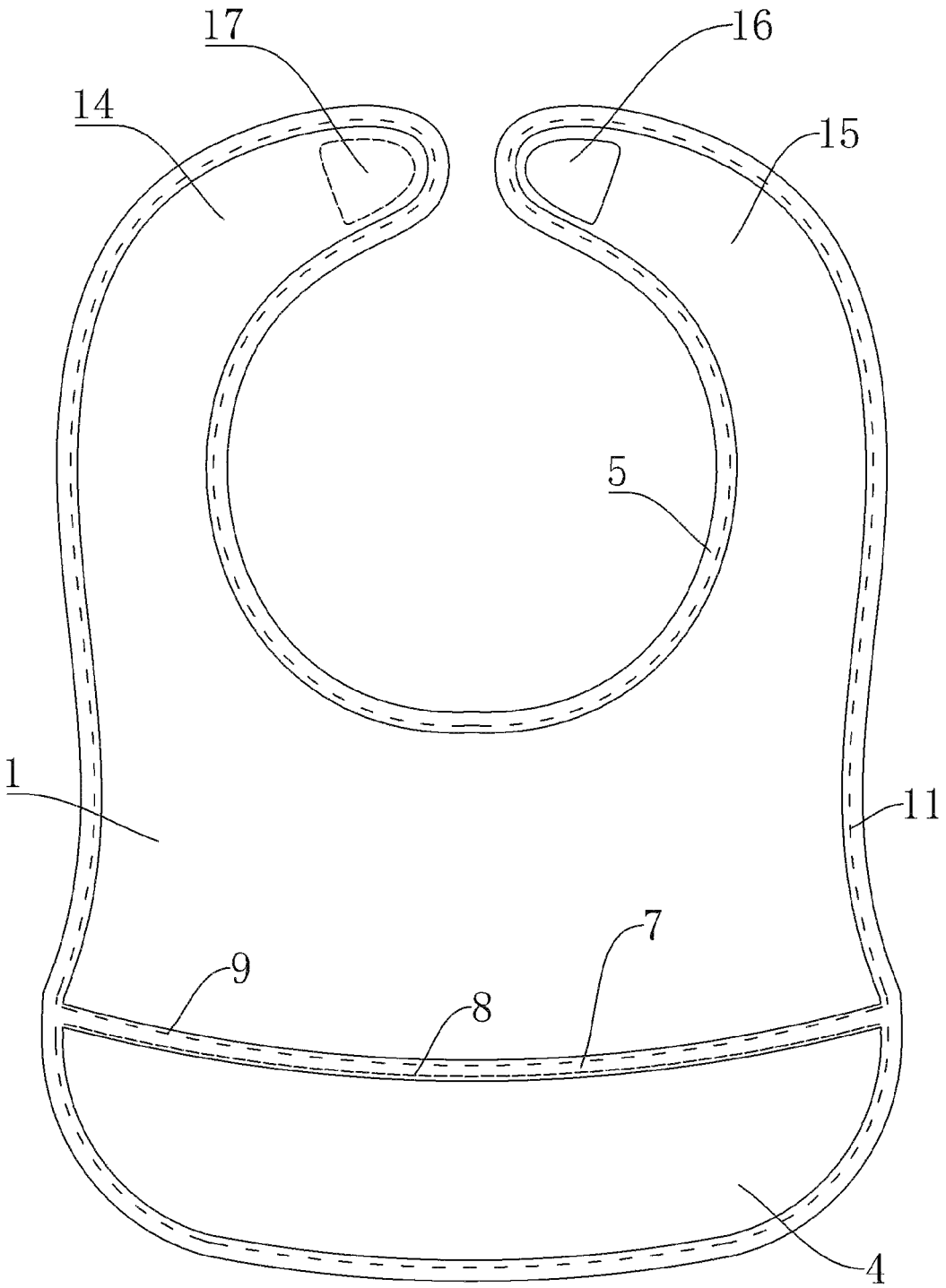

FIG. 6 is a rear view of a bib according to an embodiment of the disclosure.

Figure 7:
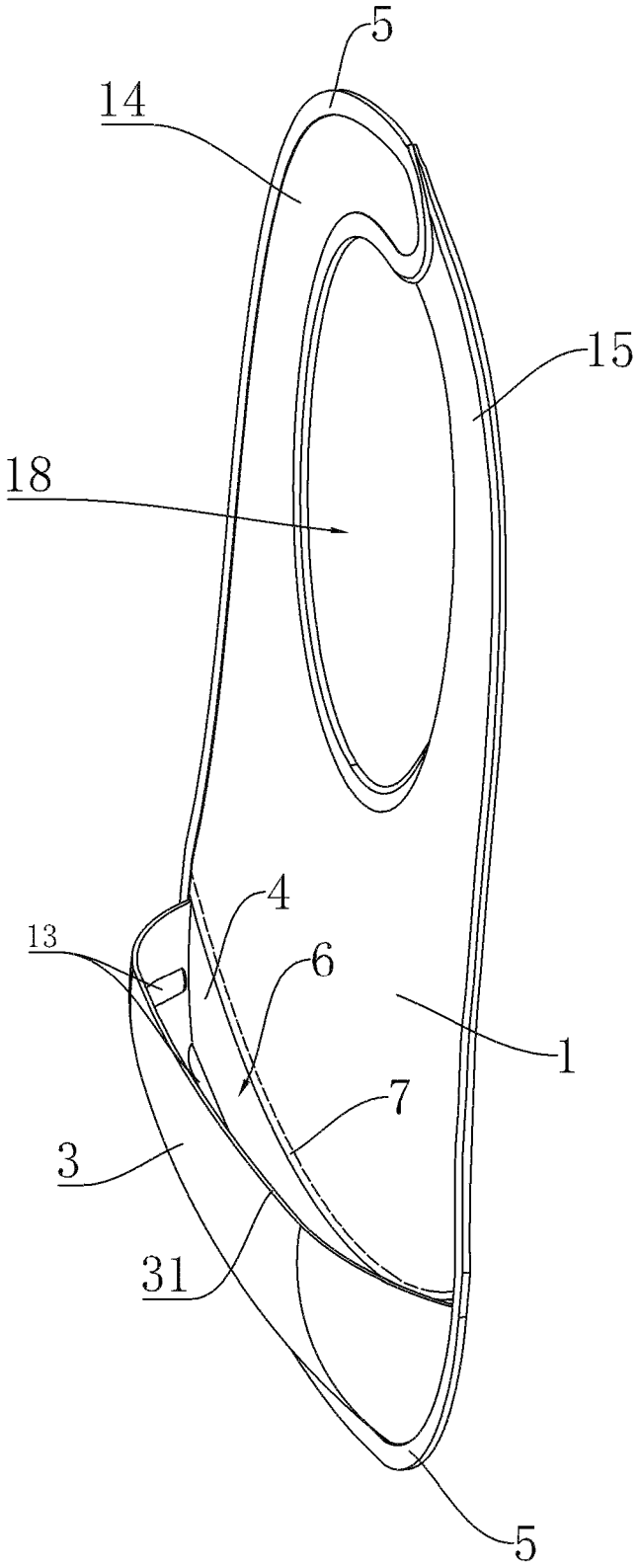

FIG. 7 is a schematic view of a three-dimensional structure of the bib in use according to an embodiment of the disclosure.

Figure 8:
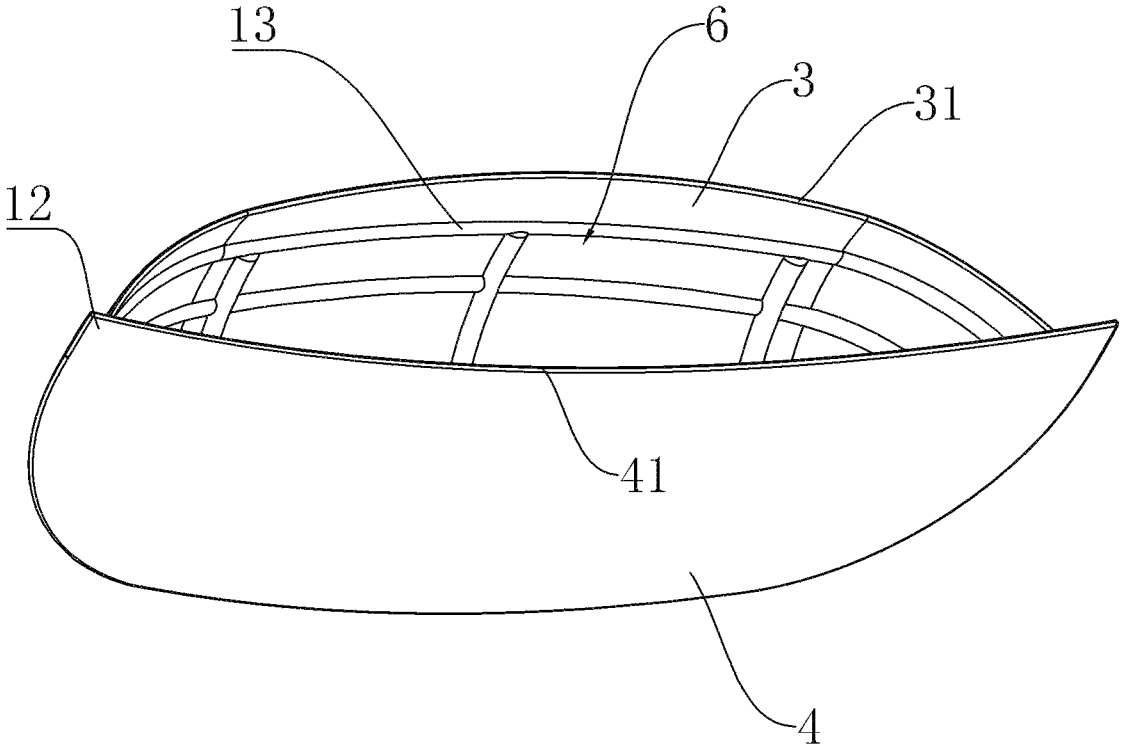

FIG. 8 is a schematic view 2 of the three-dimensional structure of the bib body according to an embodiment of the disclosure.

The reference numerals are: bib cloth 1, front bib piece 3, rear bib piece 4, first covered edge 5, opening 6, second covered edge 7, second stitching line 8, third stitching line 9, sewing strip 10, first stitching line 11, extension portion 12, convex strip 13, first strap 14, second strap 15, female hook-and-loop fastener side 16, male hook-and-loop fastener side 17, toddler neck avoidance zone 18, front bib part 19, rear bib part 20, front bib piece upper edge 31, and rear bib piece upper edge 41.

DESCRIPTION OF THE EMBODIMENTS

Embodiments of the Disclosure

Regarding most of the soft rubber bib bodies on the market, as shown in FIG. 1, each includes a front bib part 19 and a rear bib part 20 with a larger area. The upper end of the rear bib part 20 exceeds the upper end of the front bib part 19 significantly, and this excess part causes the weight of the soft rubber bib body to be heavy, and the comfort of use is reduced accordingly. Further, the soft rubber bib body lacks a part that can be sewn integrally with the bib cloth, so that the final bib produced has poor integrity.

As shown in FIG. 2, the disclosure provides a light bib body including a front bib piece 3 and a rear bib piece 4 that are integrally formed. An accommodating cavity for containing food residues is formed between the front bib piece 3 and the rear bib piece 4, and a whole front bib piece upper edge 31 is higher than a rear bib piece upper edge 41. It should be explained that generally speaking, the front bib piece 3 being higher than the rear bib piece 4, which in a narrow sense means that, except for the end portions of the two, the front bib piece upper edge 31 is always higher than the rear bib piece upper edge 41 at the same position. In a broad sense, it refers to the design for the purpose of reducing the weight of the bib body. The design of the bib body with a high front and a low back ensures that food residues can fall into the accommodating cavity of the bib body and the weight of the bib body is reduced, so the bib body is suitable for a toddler to use. To be specific, the whole rear bib piece upper edge 41 is concave or horizontal, and whole rear bib piece upper edge 41 is lower than the front bib piece upper edge 31. In this embodiment, the rear bib piece upper edge 41 is a concave arc.

As shown in FIGS. 3 and 4, the front bib piece 3 and the rear bib piece 4 are both made of a soft rubber material, and the rear bib piece 4 is a flat sheet body shaped like a crescent. The front bib piece 3 is a three-dimensional curved surface and forms an upward-facing opening 6 together with the rear bib piece 4. The front bib piece upper edge 31 is an upwardly convex arc, that is, an arc that is low at both ends and high in the middle. The front bib piece upper edge 31 and the rear bib piece upper edge 41 have two intersections D on the projection of the front view. Between the two intersections D, the rear bib piece upper edge 31 is higher than the front bib piece upper edge 41, that is, in this area, the front bib piece 3 shields the rear bib piece 4. Outside the two intersections D, the upper edges of both ends of the rear bib piece 4 are higher than the upper edges of both ends of the front bib piece 3.

The outer outline of the rear bib piece 4 has a narrow and flat sewing strip 10 extending outwards, and the sewing strip 10 is used for sewing a covered edge. The covered edge stitched on the sewing strip 10 expanding relative to the front bib piece 3 may not affect the opening degree of the opening 6 on the bib body, so that food residues may fall into the bib body as much as possible. The left and right ends of the rear bib piece 4 are provided with extension portions 12 extending outwards and overlapping with the sewing strip 10. The extension portions 12 are higher than the upper edges of both ends of the front bib piece 3, and each of the extension portions 12 is flat as well, has a width just right for sewing the covered edge, and is connected to the rear bib piece upper edge 41. The flat sewing strip 10 and the flat extension portions 12 make sewing easier.

In order to maintain the shape of the opening 6 on the bib body, an inner surface of the front bib piece 3 and an inner surface of the rear bib piece 4 are integrally formed with convex strips 13 that are arranged in an alternating manner. A thickness of each of the convex strips 13 is slightly thicker than that of the front bib piece 3 and that of the rear bib piece 4, so the convex strips 13 are like the skeleton of the front bib piece 3 and support the front bib piece 3 to a certain extent. In this way, the front bib piece 3 is not easily deformed at the positions with the convex strips 13 and may be easily restored to its original shape. The convex strips 13 also support the rear bib piece 4, so that the rear bib piece 4 may not be easily collapsed due to gravity.

A bib, as shown in FIG. 7, includes the abovementioned light bib body and a piece of bib cloth 1 made of light cloth, and the bib body is sewn below the bib cloth 1. The bib is lighter than an all-soft rubber bib and is easier to clean than an all-fabric bib. When the bib body and the bib cloth 1 are sewn together, the lower end of the bib cloth 1 is connected and fixed to rear bib piece upper edge 41, and the overall outer outline formed by connecting the bib cloth 1 and the bib body is wrapped by a first covered edge 5.

As shown in FIG. 5 to FIG. 7, the connection of the lower end of the bib cloth 1 and the rear bib piece upper edge 41 is implemented as follows: the lower end of the bib cloth 1 is formed with a second covered edge 7 which is wrapped and sewn on the rear bib piece upper edge 41. To be specific, the lower end of the bib cloth 1 has a curve corresponding to the rear bib piece upper edge 41. The lower end of the bib cloth 1 is folded to wrap the rear bib piece upper edge 41, and only a small part of the lower end of the bib cloth 1 is covered on the rear surface of the rear bib cloth 4. Sewing is performed along the curve of the lower end of the bib cloth 1 at a position close to the lowermost end of the bib cloth 1 to form a second stitching line, and the bib cloth 1 as a whole faces downwards. The bib cloth 1 is folded upwards at the second stitching line 8, so that the bib cloth as a whole faces upwards. Finally, stitching is performed along the arc of the rear bib piece upper edge 41 at a position close to the rear bib piece upper edge 41, and a third stitching line 9 is formed. The part of the bib cloth 1 from the lowermost end of the bib cloth 1 to the third stitching line 9 forms the second covered edge 7.

The first covered edge 5 is a long strip of cloth, and the center of the long strip of cloth is folded in half and wrapped around the outer outline of the sewing strip 10 and the bib cloth 1. To be specific, after the lower end of the bib cloth 1 is connected to the rear bib piece upper edge 41, the first covered edge 5 is arranged around the outer outline of the bib cloth 1 from any part of the bib cloth 1, extends downwardly onto the sewing strip 10 from the junction of the bib cloth 1 and the rear bib piece 4, go goes around the entire sewing strip 10 and back to the starting point on the bib cloth 1. After the first covered edge 5 is sewn, the connected bib cloth 1 and the bib body are surrounded to form a first stitching line 11.

The front bib piece upper edge 31 is higher than the rear bib piece upper edge 41, so that the front bib piece 3 may basically block the sewing line of the rear bib piece upper edge 41, and attractiveness is thereby improved. The extension portions 12 are connected to the rear bib piece upper edge 41, so that the rear bib piece 4 and the bib cloth 1 may thus be tightly stitched.

The bib cloth 11 includes a first strap 14 and a second strap 15. A rear surface of the first strap 14 is provided with a female hook-and-loop fastener side 16, a front surface of the second strap 15 is provided with a male hook-and-loop fastener side 17, and after the ends of the two are connected, an toddler neck avoidance zone 18 is formed on the bib cloth 1.

What is claimed is:

1. A bib, comprising a light bib body, a piece of bib cloth made of a piece of light weight cloth, wherein the light bib body is sewn below the piece of bib cloth, wherein the light bib body and piece of bib cloth are sewn together, the light bib body, comprising a front bib piece and a rear bib piece that are integrally formed, wherein an accommodating cavity for containing food residues is formed between the front bib piece and the rear bib piece, two sides of the piece of bib cloth are provided with a first covered edge, the first covered edge extends downwards from a junction of the piece of bib cloth and the rear bib piece, and the first covered edge is formed by wrapping on a sewing strip of the light bib body, the piece of bib cloth is further provided with a second covered edge, and the second covered edge is sewn on a rear bib piece upper edge, the front bib piece and the rear bib piece are made of a soft rubber material;

wherein: an outer outline of the rear bib piece has the sewing strip extending outwards, left and right ends of the rear bib piece are provided with extension portions extending outwards and overlapping with the sewing strip, and the extension portions are higher than the upper edges of the end portions of the front bib piece;

wherein: an inner surface of the front bib piece and an inner surface of the rear bib piece are provided with convex strips that that arranged in an alternating manner for maintaining a shape of an opening, the convex strips are arranged to further keep a posture of a front arch of the front bib piece and a posture of a rear arch of the rear bib piece, and the convex strips are arranged longitudinally and laterally on the front bib piece, and the convex strips are also arranged longitudinally and laterally on the rear bib piece;

wherein: the second covered edge formed by folding below the piece of bib cloth is wrapped and sewn on the rear bib piece upper edge; and wherein: the sewing strip, the extension portions, and the outer outline of the piece of bib cloth are all wrapped by the first covered edge, and the first covered edge surrounds the light bib body and the piece of bib cloth.

2. The bib according to claim 1, wherein: the whole upper edge of the rear bib piece is concave and forms a concave arc, or the whole upper edge of the rear bib piece is horizontal.

3. The bib according to claim 1, wherein: the rear bib piece is generally flat, the front bib piece is a three-dimensional curved surface and forms an upward-facing opening together with the rear bib piece, and the opening is at an upper end of the accommodating cavity.

4. The bib according to claim 1, wherein: the whole upper edge of the rear bib piece is concave and forms a concave arc; and a front bib piece upper edge is an arc that is low at two ends and high in a middle portion between the two ends.

5. The bib according to claim 4, wherein: upper edges of two end portions of the rear bib piece are positioned higher than upper edges of end portions of the front bib piece; and wherein upper edges of the middle portion of the front bib piece are positioned higher than upper edges of a middle portion of the rear bib piece.

6. A bib, comprising a light bib body, a piece of bib cloth made of a piece of light weight cloth, wherein the light bib body is sewn below the piece of bib cloth, wherein the light bib body and piece of bib cloth are sewn together, the light bib body, comprising a front bib piece and a rear bib piece that are integrally formed, wherein an accommodating cavity for containing food residues is formed between the front bib piece and the rear bib piece, two sides of the piece of bib cloth are provided with a first covered edge, the first covered edge extends downwards from a junction of the piece of bib cloth and the rear bib piece, and the first covered edge is formed by wrapping on a sewing strip of the light bib body, the piece of bib cloth is further provided with a second covered edge, and the second covered edge is sewn on a rear bib piece upper edge, and the front bib piece and the rear bib piece are made of a soft rubber material;

wherein: the whole upper edge of the rear bib piece is concave and forms a concave arc, or the whole upper edge of the rear bib piece is horizontal;

wherein: the rear bib piece is generally flat, the front bib piece is a three-dimensional curved surface and forms an upward-facing opening together with the rear bib piece, and the opening is at an upper end of the accommodating cavity;

wherein: a front bib piece upper edge is an arc that is low at two ends and high in a middle portion between the two ends;

wherein: upper edges of two end portions of the rear bib piece are positioned higher than upper edges of end portions of the front bib piece;

wherein upper edges of the middle portion of the front bib piece are positioned higher than upper edges of a middle portion of the rear bib piece;

wherein: an outer outline of the rear bib piece has the sewing strip extending outwards, left and right ends of the rear bib piece are provided with extension portions extending outwards and overlapping with the sewing strip, and the extension portions are higher than the upper edges of the end portions of the front bib piece;

wherein: an inner surface of the front bib piece and an inner surface of the rear bib piece are provided with convex strips that that arranged in an alternating manner for maintaining a shape of an opening, the convex strips are arranged to further keep a posture of a front arch of the front bib piece and a posture of a rear arch of the rear bib piece, and the convex strips are arranged longitudinally and laterally on the front bib piece, and the convex strips are also arranged longitudinally and laterally on the rear bib piece;

wherein: the second covered edge formed by folding below the piece of bib cloth is wrapped and sewn on the rear bib piece upper edge; and wherein: the sewing strip, the extension portions, and the outer outline of the piece of bib cloth are all wrapped by the first covered edge, and the first covered edge surrounds the light bib body and the piece of bib cloth.

* * * * *